United States Patent [19]

Sato et al.

[11] Patent Number: 4,535,831

[45] Date of Patent: Aug. 20, 1985

[54] PATTERN FOR PRODUCING A MOLD AND METHOD FOR MANUFACTURE OF THE PATTERN

[75] Inventors: Kan-ichi Sato; Akio Yamanishi; Takashi Higashino, all of Hirakata, Japan

[73] Assignee: Kabushiki Kaisha Komatsu Seisakusho, Tokyo, Japan

[21] Appl. No.: 357,273

[22] Filed: Mar. 11, 1982

[30] Foreign Application Priority Data

Mar. 17, 1981 [JP] Japan ..... 56-37215

[51] Int. Cl.[3] ..... B22D 13/10

[52] U.S. Cl. ..... 164/33; 164/34; 164/45; 164/228; 164/230

[58] Field of Search ..... 164/6, 13, 15, 23, 27, 164/33, 34, 45, 516, 228, 230

[56] References Cited

U.S. PATENT DOCUMENTS

| | | | |
|---|---|---|---|
| Re. 26,785 | 2/1970 | Kaplan | 164/35 X |
| 2,399,373 | 4/1946 | Miller | 164/13 |
| 2,755,528 | 7/1956 | Bücken | 164/6 |
| 3,204,303 | 9/1965 | Chandley | 164/23 |
| 4,254,544 | 3/1981 | Barker | 164/34 X |

FOREIGN PATENT DOCUMENTS

| | | | |
|---|---|---|---|
| 47-9470 | 3/1972 | Japan . | |
| 47-34447 | 8/1972 | Japan . | |
| 49-12965 | 3/1974 | Japan . | |
| 55-30341 | 3/1980 | Japan . | |
| 55-30342 | 3/1980 | Japan . | |
| 55-84247 | 6/1980 | Japan . | |
| 55-84618 | 6/1980 | Japan . | |
| 635363 | 4/1950 | United Kingdom | 164/6 |

OTHER PUBLICATIONS

*Plaster Plugs from Rubber Molds,* C. W. Ammen, "Foundry", vol. 84, No. 2, Feb. 56, pp. 142, 146, 149.

*Primary Examiner*—Howard N. Goldberg
*Assistant Examiner*—Timothy V. Eley
*Attorney, Agent, or Firm*—Armstrong, Nikaido, Marmelstein & Kubovcik

[57] ABSTRACT

A method of producing a pattern for use in the manufacture of a mold which is adapted to be cured by microwave irradiation. The method comprises forming a rolled-over male pattern, forming a rolled-over female pattern having a scale-off layer along a boundary thereof with the male pattern, removing the scale-off layer, pouring a silicone RTV rubber into a cavity of the female pattern to form a match plate therein, setting a metallic frame on the match plate, filling the interior of the metallic frame with a mixture of microwave-pervious resin and dry silica sand, causing the mixture to be thermally cured thereby forming a reinforcing layer on the peripheral surface of the match plate, placing the male pattern within the reinforcing layer after removing the match plate therefrom, and injecting a microwave-pervious silicone rubber into the gap formed between the reinforcing layer and the male pattern thereby forming a mold defining layer on the inner surface of the reinforcing layer.

2 Claims, 13 Drawing Figures

PATTERN FOR PRODUCING A MOLD AND METHOD FOR MANUFACTURE OF THE PATTERN

BACKGROUND OF THE INVENTION

This invention relates to a pattern to be used for the production of a mold by a method which involves filling a pattern with a molding material incorporating a thermosetting binding agent and a substance dielectric to microwaves and thereafter irradiating the molding material with microwaves thereby causing the molding material to cure with the heat of its own generation, and to a method for the manufacture of the pattern.

A typical method heretofore known in the production of a mold has used a procedure which comprises forming a pattern of a metallic material, heating this pattern, then spraying a powdered facing agent on the surface of the heated pattern thereby covering the surface with an applied coat of the facing agent about 0.4 mm in thickness, further applying thereto a molding material containing a thermosetting resin, curing the applied coat of the molding material with the heat transferred through the metallic pattern, and thereafter separating the pattern to release the produced mold. By this method can be produced a mold of good casting surface enjoying the same accuracy as the surface of a metallic pattern. This method, however, necessitates application of heat to the pattern and inevitably entails preparation of an expensive metallic pattern. The pattern, therefore, is costly and difficult to produce. This method has an additional disadvantage that since the molding material is cured with the heat transferred through the metallic pattern, the loss of energy is heavy and the efficiency of the use of energy is inferior. Besides, since this method uses a powdered facing agent, the application of the facing agent becomes difficult when the metallic pattern has a complicated contour. Moreover since the facing agent is required to be applied substantially perpendicularly to the surface of the metallic pattern, there must be used a coating device designed exclusively to that end. These also constitute disadvantages of the method under discussion.

A suggestion offered for the elimination of these disadvantages is found in U.S. patent application Ser. No. 237,767 filed on Feb. 24, 1981. The method for producing a mold covered by this U.S. patent application uses a procedure which comprises forming a pattern with a material such as silicone rubber or ceramics permitting ready passage of microwaves and yet possessing proper degrees of elasticity and thermal resistance, applying a facing agent to the surface of the pattern, then filling this pattern with a molding material incorporating a thermosetting binding agent and a substance dielectric to microwaves, and irradiating the molding material with microwaves thereby causing the dielectric substance contained in the molding material to generate heat and consequently enabling the binding agent to be cured with the heat.

Patterns to be used for the production of molds as by the method described above have been suggested in U.S. patent application Ser. No. 269,967 filed on June 3, 1981, for example. The patterns which are disclosed in this U.S. patent application include a pattern which has a front layer of silicone rubber or fluororubber lined with a rear layer consisting of thermally insulating, rigid styrene resin, acrylic resin, or epoxy resin sparingly susceptible to loss of microwave energy and glass fibers or ceramic substance and a pattern which has a matrix of inexpensive and easily moldable dry wood, synthetic wood, epoxy resin, or acrylic resin and a thin film of silicone rubber of fluororubber applied to the surface of the matrix, for example.

The conventional patterns mentioned above, however, have inevitably proved expensive because their manufacture entails much time and labor. Further because of their bulkiness, these patterns weigh much and it is difficult to handle them.

Moreover, owing to relatively poor strength, they have readily sustained breakage during use.

SUMMARY OF THE INVENTION

It is therefore an object of the present invention to provide an improved method for producing a pattern for use in the manufacture of a mold which can overcome the above noted problems of the prior art.

Another object of the present invention is to provide a method for producing a pattern for use in the manufacture of a mold which is adapted to be thermally cured by microwave irradiation wherein the pattern can be produced easily and inexpensively.

A further object of the present invention is to provide a pattern for the production of a mold wherein the pattern is less likely to be broken while in use.

In accordance with an aspect of the present invention, there is provided a pattern for the production of a mold, which comprises a metallic frame, a reinforcing layer supported by the metallic frame, and a mold defining layer adhering fast to the surface of the reinforcing layer, with the reinforcing layer formed of a material such as a combination material of a nonpolar epoxy resin and dry silica sand which is readily penetrated by microwaves and the mold defining layer formed of a material such as heatproof silicone rubber which is easily penetrated by microwaves.

This invention has also made it feasible to manufacture the aforementioned pattern efficiently and inexpensively by providing a method for the manufacture of a mold, which comprises forming a rolled-over male pattern by means of a wooden pattern, then, with the aid of the rolled-over male pattern, forming a rolled-over female pattern incorporating a thin-walled scale-off layer along the boundary thereof with the rolled-over male pattern, removing the aforementioned scale-off layer from the rolled-over female pattern, then pouring silicone RTV rubber into the cavity therebetween and consequently forming a match plate therein, setting a metallic frame on the match plate, filling the interior of the metallic frame with a combination material of microwave-pervious resin and dry silica sand, causing the combination material to be thermally cured in place thereby forming a reinforcing layer on the peripheral surface of the aforementioned match plate, subsequently placing the aforementioned rolled-over male pattern inside the aforementioned reinforcing layer, and injecting microwave-pervious heatproof rubber, for example, into the gap formed between the rolled-over male pattern and the aforementioned reinforcing layer thereby forming a mold defining layer on the inner surface of the aforementioned reinforcing layer.

This invention achieves the following effects.

First, the pattern of the present invention acquires a sturdy construction having a reinforcing layer and a metallic frame on the periphery of a mold defining layer and, therefore, has no possibility of being broken by impulses such as of a drop. Since the provision of the metallic frame permits a decrease in the thickness of the reinforcing layer, the weight of the entire pattern can be proportionally decreased. Since the metallic frame has no closed face on the reinforcing layer side, it exerts virtually no effect upon the thermal setting of the combination material by microwaves.

Further since the reinforcing layer is formed of a combination material of resin and dry silica sand which are both highly pervious to microwaves, the molding of the reinforcing layer can be effected with ease and the reinforcing layer itself enjoys greater strength than a reinforcing layer to be formed solely of resin. The reinforcing layer, therefore, fulfils its intended function amply.

Moreover, the pattern for the production of a mold cured by microwaves can be easily manufactured insofar as an ordinary wooden pattern is available at all. The shape of the pattern can easily be altered by modifying the rolled-over pattern converted from the wooden pattern and re-forming the mold defining layer. The pattern of this invention, accordingly, enjoys very easy design change as compared with the conventional resin pattern.

The above and other objects, features and advantages of the present invention will be readily apparent from the following description taken in conjunction with the accompanying drawings.

DESCRIPTION OF THE PREFERRED EMBODIMENTS

First, the embodiment of this invention for the manufacture of a pattern 10 will be described with reference to FIGS. 1 through 8.

Figure 1:
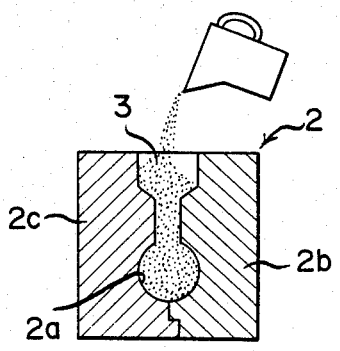
FIGS. 1 through 7 are sectioned views collectively illustrating a series of steps for the manufacture of a typical pattern of the present invention.
Figure 2:
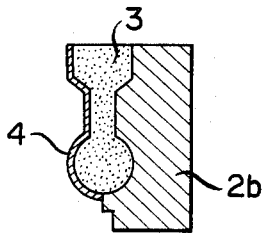
Figure 3:
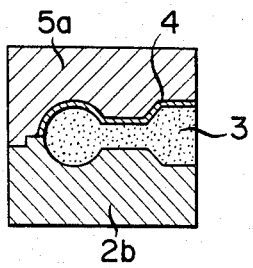

In a wooden pattern having a cavity 2*a* perfectly conforming with a pattern 10 desired to be manufactured, heatproof resin or hard gypsum is cast to form a rolled-over male pattern 3. This rolled-over male pattern 3 is fitted into one wooden pattern 2*b* and the other wooden pattern 2*c* is removed. To the exposed surface of the rolled-over male pattern 3, clay or wax sheet is applied in a total thickness of several millimeters to form a scale-off layer 4. On this scale-off layer 4, the same heatproof resin or hard gypsum is cast to form a rolled-over female pattern 5*a* (FIG. 3).

Figure 4:
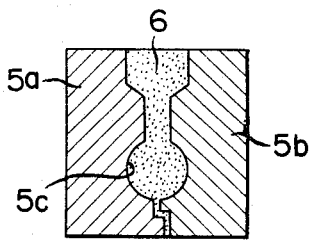

Subsequently, the opposite wooden pattern 2*b* is removed to expose additionally the opposite surface of the rolled-over male pattern 3. To this exposed surface, the same clay or wax sheet is applied similarly in a total thickness of several millimeters to form a scale-off layer 4. On the scale-off layer 4, the heatproof resin or hard gypsum is cast to give rise to a roller-over female pattern 5*b*. From the pair of rolled-over female patterns 5*a*, 5*b* obtained as described above, the scale-off layers 4 are removed. Then the patterns 5*a*, 5*b* are opposed to each other across a gap of several millimeters. Silicone RTV rubber is injected into a cavity 5*c* which is consequently formed between the opposed rolled-over female patterns 5*a*, 5*b* to produce a match plate 6 of silicone RTV rubber (FIG. 4).

Figure 5:
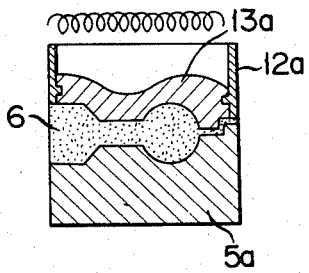

As the produced match plate 6 is still retained fast in the rolled-over female pattern 5*a*, the other side of the match plate is exposed as turned upwardly. A metal frame 12*a* is mounted on the exposed surface of the match plate. A combination material of nonpolar epoxy resin and dry sand is poured into the metal frame 12*a* and it is immediately swept with hot air or irradiated with heat rays from an infrared lamp, so that the combination material will be cured along the contour of the match plate to produce a reinforcing layer 13*a* (FIG. 5). Subsequently, the rolled-over female pattern 5*a* on the opposite side is removed and the procedure described above is repeated to form a reinforcing layer 13*b* of the same combination material.

Figure 6:
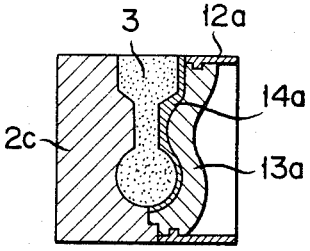
Figure 7:
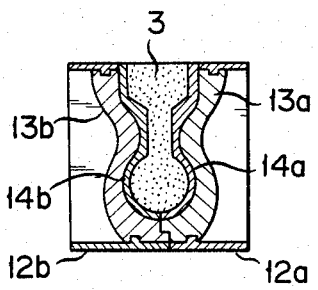

The rolled-over male pattern 3 is fitted into one segment 2*c* of the wooden pattern 2 used formerly. Then, the part of the rolled-over male pattern 3 exposed from the wooden pattern 2*c* is crowned with one reinforcing layer 13*a* still retained in the metal frame 12*a* as illustrated in FIG. 6. Into the gap which is consequently formed between the rolled-over male pattern 3 and the reinforcing layer 13*a*, heatproof silicone rubber, for example, which is pervious to microwaves is injected to form a mold defining layer 14*a*. The wooden pattern 2*c* is removed after the mold defining layer 14*a* is cured. On the side of the rolled-over male pattern 3 which is consequently exposed, the other reinforcing layer still retained in the metallic frame 12*b* is mounted. Into the gap formed between the rolled-over male pattern 3 and the reinforcing layer 13*b*, the same heatproof silicone rubber is injected and cured to produce a mold defining layer 14*b* (FIG. 7).

Figure 8:
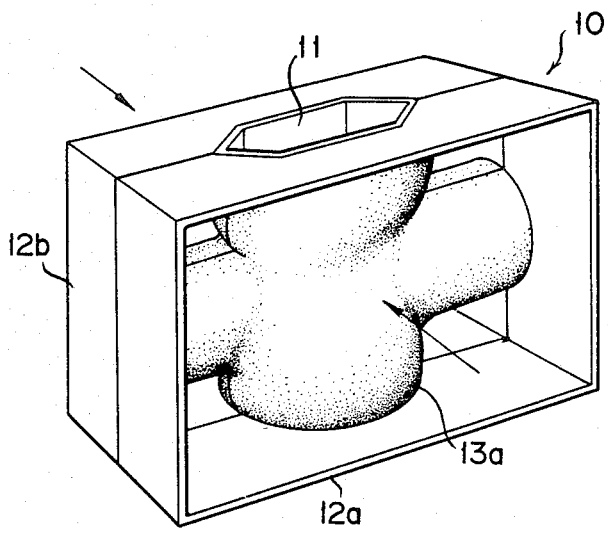
FIG. 8 is a perspective view of a typical pattern according to the present invention.

The pattern 10 which is consequently obtained acquires a construction wherein part of its cavity 11 opens toward the lateral sides of the metallic frames 12*a*, 12*b* and the reinforcing layers 13*a*, 13*b* and the mold defining layers 14*a*, 14*b* assume their positions along the open lateral sides of the metallic frame as illustrated in FIG. 8. During the irradiation of the molding material with microwaves, therefore, the microwaves are allowed to penetrate into the pattern through the openings of the aforementioned metallic frames 12*a*, 12*b* and those of the cavity 11.

In the procedure of manufacture described above, the match plate is formed of silicone RTV rubber. The use of this particular rubber for the match plate has the effect of providing a waterproof screen for the resin which, as the raw material for the reinforcing layers 13*a*, 13*b*, abhors water while in process of being cured to produce the reinforcing layers and, at the same time, ensuring easy separation of the produced match plate from the reinforcing layers 13*a*, 13*b* without necessitating the use of any mold releasing agent. Since the otherwise desirable use of a mold releasing agent is obviated, the reinforcing layers 13*a*, 13*b* are allowed to adhere fast to the mold defining layers 14*a*, 14*b* which are to be formed in the subsequent step. The fastness of this adhesion is enough to prevent the mold defining layers 14*a*, 14*b* from being separated while in use.

By the method described above can be manufactured a pattern for the production of a mold, which comprises metal frames 12*a*, 12*b*, reinforcing layers 13*a*, 13*b* supported within the metal frames, and mold defining layers 14*a*, 14*b* held in intimate contact with the interiors of the reinforcing layers and having the inner faces thereof define a cavity 11, with the reinforcing layers 13*a*, 13*b* being formed of a combination material of nonpolar epoxy resin and dry silica sand which permits ready passage of microwaves and the mold defining layers 14*a*, 14*b* being formed of heatproof silicone rubber, for example, which likewise permits ready passage of microwaves. The embodiment so far described has concerned a pattern of the type of a corebox. The pattern contemplated by this invention is not necessarily limited to this type. Of course, it can be used for the production of a mold of varying type.

Now, the method to be followed in producing a mold by use of the pattern illustrated above will be described in detail below.

Figure 9:
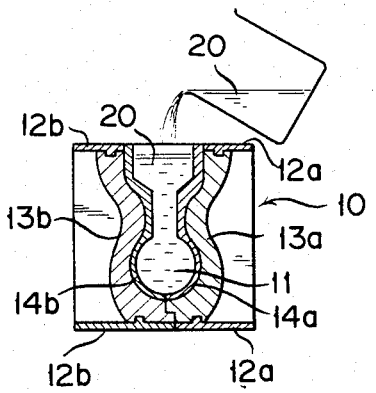
FIGS. 9 through 13 are sectioned views collectively illustrating a series of steps in one embodiment of the method of this invention for the manufacture of a mold by use of the pattern of this invention, FIG. 9 representing the step in which the facing agent is poured into the pattern, FIG. 10 representing the step in which an excess of facing agent is discharged out of the pattern, FIG. 11 representing the step in which the molding material is placed to fill the interior of the pattern having the facing agent adhered fast to the surface thereof, FIG. 12 representing the step in which the pattern filled with the molding material is irradiated with microwaves to cure the molding material and the facing agent, and FIG. 13 illustrating the cured mold in a state removed from the pattern.

This method of manufacture essentially comprises the following steps, (1) through (5):

(1) The step in which facing agent 20 in a liquid form is poured into the cavity 11 of the pattern 10 at a temperature in the range of from room temperature to 60° C. (FIG. 9).

Figure 10:
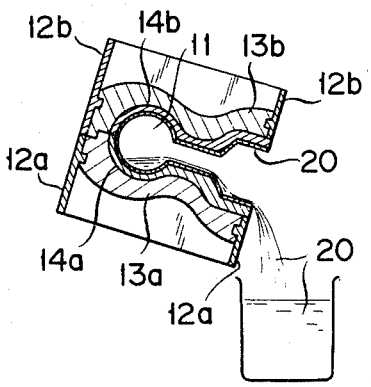

(2) The step in which the residue of the facing agent 20 is discharged from within the cavity 11 of the pattern 10. The other part of the facing agent 20 has already been deposited to the inner face of the pattern 10 defining the cavity 11 (FIG. 10).

Figure 11:
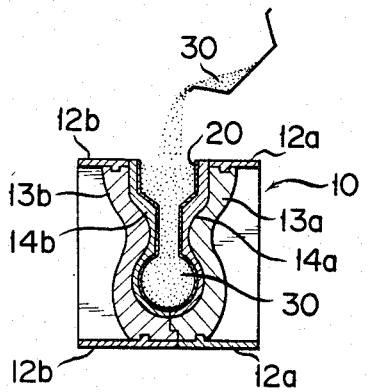

(3) The step in which the cavity 11 of the pattern 10 is filled with the molding material 30 while the pattern is kept in a shaken state (FIG. 11).

Figure 12:
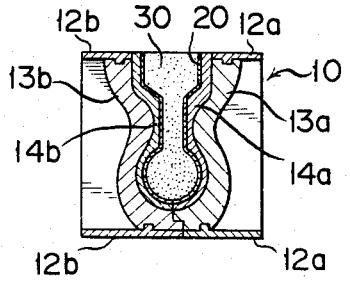

(4) The step in which the pattern 10 filled with the molding material 30 is irradiated with microwaves to cure the molding material 30 and the facing agent 20 (FIG. 12).

Figure 13:
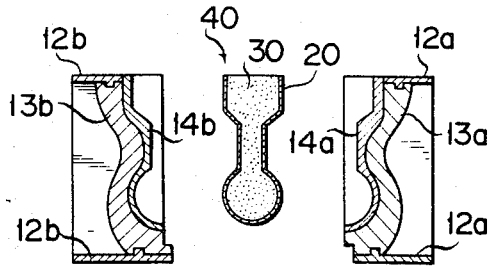

(5) The step in which the cured mold 40 is released from the pattern (FIG. 13).

The mold can be manufactured by the series of steps (1) through (5) described above. Preferred examples of the facing agent and the molding material to be used for the manufacture of the mold by this series of steps will be described specifically below.

FACING AGENT

A typical facing agent usable for the embodiment described above is obtained by adding 20 to 40 parts by weight of resin, 20 to 30 parts by weight of iron sand, 0.5 to 1.0 parts by weight of vinyl acetate, and a suitable amount of water or alcohol to 100 parts by weight of refractory particles. It is for the purpose of cushioning the facing layer from thermal expansion that vinyl acetate is used as one of the additives to the facing agent. Iron sand ($Fe_3O_4$) is used for the purpose of precluding the veining. When the application of the facing agent to the surface of the pattern is made by pouring the facing agent into the cavity 11 of the pattern as described above or by completely immersing the pattern in a bath of the facing agent, the facing agent is desired to be adjusted in advance to a concentration of at least 75 Be with water used as the solvent therefor in due consideration of the covering property to be shown by the facing agent as to silicone rubber, for example. When the application of the facing agent is performed by spraying, the concentration of the facing agent is desired to be about 70 Be. The solvent to be used for the adjustment of the concentration may be water or alcohol, whichever may prove advantageous on the particular occation. Examples of the facing agent are shown below.

EXAMPLE 1

To 100 parts by weight of zircon particles (JIS particle size index 500) as a principal ingredient are added 30 parts by weight of phenol resin, 20 parts by weight of iron sand, 0.5 part by weight of vinyl acetate, and 10 parts by weight of water. The blending of the ingredients is effected by stirring for about three minutes. The facing agent consequently obtained has a concentration of about 82 Be. The method of corebox submersion is suitable for the application of this facing agent to the surface of the pattern. Since the facing agent contains 20 parts by weight of iron sand, the mold produced by using this facing agent can be used for molding aluminum alloys and cast iron. It can also be used for molding cast steel without entailing the phenomenon of seizure.

EXAMPLE 2

To 100 parts by weight of finely divided, molten quartz particles (JIS particle size index 490) as a principal ingredient are added 30 parts by weight of phenol resin, 30 parts by weight of iron sand, 0.5 part by weight of vinyl acetate, and 31.5 parts by weight of water. The blending of these ingredients is effected by stirring for about five minutes. The facing agent thus produced has a concentration of 80 Be and is suitable mainly for facing cast iron. The application of this facing agent to the surface of a pattern can be carried out by the corebox immersion method or the spray method.

EXAMPLE 3

To 100 parts by weight of powdered alumina (JIS particle size index 500) as a principal ingredient are added 40 parts by weight of phenol resin, 20 parts by weight of iron sand, 1.0 part by weight of vinyl acetate, and 28 parts by weight of alcohol. The blending of these ingredients is effected by stirring for about five minutes.

EXAMPLE 4

To 100 parts by weight of powdered quartzite (JIS particle size index 490) as a principal ingredient are added 35 parts by weight of phenol resin, 20 parts by weight of iron sand, 0.5 part by weight of vinyl acetate, and 35 parts by weight of alcohol. The blending of these ingredients is2 effected by stirring for about five minutes.

Although the four typical examples of the composition of the facing agent have been cited above, the composition of the facing agent which can be used for the manufacture of a mold by the method of this invention is not limited to these examples. The fact that powdered zircon, finely divided molten quartz, powdered alumina, and powdered quartzite are used in these examples does not imply that no other refractory particles are usable. Although phenol resin is used as the most desirable resin in all the cited examples, other suitable resins such as urea resin may be used instead when desired.

The use of the facing agent of such a composition as described above results in preclusion of the occurrence of such adverse phenomena as scab and veining ascribable to the separation of applied layer, because intimate adhesion is advantageously obtained between the applied layer and the mold defining layer at the time that the facing agent and the molding material are simultaneously caused to generate heat and cure themselves by the irradiation of microwaves. The applied layer of the facing agent turns into a rigid layer about 0.1 to 0.5 mm in thickness and adheres fast to the surface of the mold. In this case, this layer never causes any veining because the thermal expansion coefficient of the applied layer and that of the mold are practically equal. Moreover, the applied layer acquires no furrowed surface because the facing agent shows an advantageous covering property to silicone rubber, for example. Consequently, the phenomenon of seizure can be avoided.

Optionally, a facing agent which is obtained by mixing 10 parts by weight of water-soluble resol resin and 60 parts by weight of water with 100 parts by weight of powdered quartzite 300 mesh in particle size or a facing agent obtained by mixing 5 parts by weight of a mixed resin of resol and novolak and 30 parts by weight of methanol with 100 parts by weight of powdered alumina 400 mesh in particle size may be used to suit the occasion.

MOLDING MATERIAL

The molding material to be used for the manufacture of a mold by the method described above comprises a retractory substance incorporating a thermosetting binding agent and a substance dielectric to microwaves. Any refractory substance satisfying the requirement that it should generate heat and cure itself upon exposure to microwaves can be used. Preferred examples of the refractory substance will be cited below. The term "thermosetting binding agent" as used herein shall embrace what is obtained by incorporating a curing agent into a thermoplastic resin thereby imparting a thermosetting property thereto.

As the first concrete example of the molding material, there may be cited a material which contains 2 to 5 parts by weight of thermosetting resin per 100 parts by weight of dry reconditioned sand containing clay in a concentration of 0.5 to 6% and a carbonaceous organic substance in a concentration of 0.3 to 5%.

This molding material can be prepared by placing reclamation sand in an inclined rotary vessel, rotating the rotary vessel thereby imparting a complicate circulating motion to the reclamation sand, operating an agitator disposed inside the rotary vessel and adapted to turn in the direction opposite the direction of the rotation of the rotary vessel thereby exerting an impulsive frictional motion to the reclamation sand kept in the aforementioned complicate circulating motion and drying and cleaning the reclamation sand for a prescribed time, classifying the dried, clean reclamation sand and divesting it of crushed dust, adding the thermosetting resin to the resultant reconditioned reclamation sand and kneading same. The reconditioned sand prepared as described above is characterized by containing small amounts of clay and ignition residue. The clay component discharges the part of properly mitigating the thermal shock to which the mold is exposed during the introduction of molten metal into the mold. The ignition residue serves as an effective dielectric substance contributing to the heating with microwaves, because it is formed preponderantly of a carbonaceous organic substance. The reconditioned sand obtained as described above, therefore, can be used in its unaltered form as a raw material for the molding material which is intended to be cured by use of microwaves.

Examples of the thermosetting resin which is advantageously used in the preparation of the molding material include resol type phenol resin, resol-novolak mixed type phenol resin, and novolak type phenol resin (which by nature is thermoplastic and, therefore, is required to be converted into a thermosetting resin usually by incorporation of 10 to 15% of a curing agent such as hexamethylene tetramine, for example). Besides, such thermosetting resins as furan resin are also usable. When such a thermosetting resin is added to freshly supplied sand, it is generally used in an amount of 2 to 7% based on the sand. When it is added to the reconditioned sand which is obtained by the present invention, it suffices to use the thermosetting resin in an amount of 2 to 5 parts by weight per 100 parts by weight of the reconditioned sand. For example, a molding material suitable for this invention can be prepared by combining 100 parts by weight of the reconditioned sand, 3 parts by weight of powdered phenol resin (containing 15%, based on the resin, of hexamethylene tetramine and having a melting point of 70 to 97° C. and a gel time of 35 to 67 seconds/150° C.), and 0.2 part by weight of kerosene and kneading them in a kneader for three minutes.

The second preferred example of the molding material is obtained by adding phenol resin (in the form of an aqueous solution) to a dispersion of water-soluble graphite, mixing the resultant combined solution with freshly supplied sand, and drying the resulting mixture by application of heat. In this molding material, the individual sand grains have their surface covered with a carbonaceous coat. This molding material can be specifically produced by adding the dispersion of water-soluble graphite and the phenol resin (in an amount of several percent based on the weight of the dispersion of graphite) to the freshly supplied sand, mixing the combined ingredients for several minutes in a mixer, subsequently drying the resultant mixture by application of heat, and crushing as with a muller the conglomerates of sand formed when the phenol resin is cured by heat thereby effecting thorough separation of individual coated sand grains.

The desirable examples of the molding material to be used for the production of a mold by use of the pattern of the present invention have been cited. Besides these, a molding material obtained by kneading freshly supplied sand, a thermosetting resin (or a thermoplastic resin vested with a thermosetting property by incorporation of a curing agent), and a dielectric substance such as graphite and a molding material obtained by mixing a thermosetting resin and freshly supplied sand with carbonized sand capable of functioning as a dielectric substance relative to microwaves are also usable.

The pattern of this invention, the method for the manufacture of this pattern, and the facing agent and the molding material which are to be used for the production of a mold by use of the pattern have been described in detail. When the pattern and the molding material described above are used, a mold of good casting surface enjoying the same accuracy as the surface of a metal mold can be produced by two to three minutes' irradiation of microwaves 2450 MHz in frequency and 6 kW in output. Use of the mold thus produced permits manufacture of cast articles of very high quality.

What is claimed is:

1. A method of producing a pattern for use in the manufacture of a mold, comprising the steps of:

(a) forming a rolled-over male pattern by using a wooden pattern;

(b) forming a rolled-over female pattern having a thin-walled scale-off layer along a boundary thereof with said rolled-over male pattern by using the latter;

(c) removing the thin-walled scale-off layer from said rolled-over female pattern;

(d) pouring a silicone RTV rubber into a cavity of said rolled-over female pattern to form a match plate therein;

(e) setting a metallic frame on said match plate;

(f) filling the interior of the metallic frame with a mixture of microwave-pervious resin and silica sand;

(g) causing said mixture to be thermally cured thereby forming a reinforcing layer on the peripheral surface of said match plate;

(h) placing said rolled-over male pattern within said metallic-frame-supported reinforcing layer after removing said match plate therefrom; and (i) injecting a microwave-pervious and heatproof material into the gap formed between said reinforcing layer and said rolled-over male pattern thereby forming a mold defining layer on the inner surface of said reinforcing layer.

2. A method of producing a pattern according to claim 1 wherein said reinforcing layer is made of a material comprising a mixture of nonpolar epoxy resin and silica sand and wherein said mold defining layer is made of silicone rubber or fluororubber.

* * * * *